US005242009A

United States Patent [19]

Soban et al.

[11] Patent Number: 5,242,009

[45] Date of Patent: Sep. 7, 1993

[54] FOOT ROLLS FOR CONTINUOUS CASTING

[75] Inventors: Alessandro Soban, Monfalcone; Guido Marchesan, Udine, both of Italy

[73] Assignee: Danieli & C. Officine Meccanichi SpA, Buttrio, Italy

[21] Appl. No.: 873,001

[22] Filed: Apr. 24, 1992

[30] Foreign Application Priority Data

May 10, 1991 [IT] Italy ..... 000075 A91

[51] Int. Cl.[5] ..... B22D 11/124; B22D 11/12

[52] U.S. Cl. ..... 164/442; 164/443; 164/448

[58] Field of Search ..... 164/448, 442, 443

[56] References Cited

U.S. PATENT DOCUMENTS

| | | | |
|---|---|---|---|
| 3,631,916 | 1/1972 | Schwartz | 164/448 |
| 3,633,655 | 1/1972 | Hofman . | |
| 4,137,963 | 2/1979 | Langer et al. | 164/448 |
| 4,167,964 | 9/1979 | Flury | 164/448 |
| 4,452,298 | 6/1984 | Rahmfeld | 164/448 |
| 4,603,729 | 8/1986 | Kawaguchi et al. | 164/442 |

FOREIGN PATENT DOCUMENTS

| | | | |
|---|---|---|---|
| 0189854 | 8/1986 | Japan | 164/442 |
| 2029742 | 8/1979 | United Kingdom . | |

OTHER PUBLICATIONS

Handbook of continuous Casting, 1988, Aluminium Verlag Herrmann, Dusseldorf, DE p. 47, FIG. 8.

*Primary Examiner*—Richard K. Seidel
*Assistant Examiner*—Erik R. Puknys
*Attorney, Agent, or Firm*—Antonelli, Terry, Stout & Kraus

[57] ABSTRACT

Foot rolls for continuous casting which consist of at least two successive layers of assemblies of rolls (13), each assembly of rolls (13) lying substantially on the same plane, the foot rolls (13) being positioned immediately downstream of an ingot mould and immediately upstream of a discharge conveyor (11), each assembly of rolls (13) defining a geometric figure conforming to the cross section of the ingot being formed, the rolls (13) containing a stationary, cooled supporting shaft (14) secured at its ends to vertical uprights (18), the rolls (13) being supported on bearings (15) keyed to their respective shafts (14), each shaft (14) being supported and positioned on the uprights (18) and containing a first inner conduit (21*a*) connected to first radial conduits (23*a*) opening out at one end of a cooling chamber (24) within the respective roll (13), the cooling chamber (24) cooperating at its other end with second radial conduits (23*b*) connected to a second inner conduit (21*b*), which opens out in a passage (25) machined in a housing (19) that supports the terminal portions of two consecutive shafts (14).

9 Claims, 4 Drawing Sheets

FOOT ROLLS FOR CONTINUOUS CASTING

BACKGROUND OF THE INVENTION

This invention concerns foot rolls for continuous casting. To be more exact, the foot rolls of this invention are positioned immediately downstream of the ingot mould employed in continuous casting plants.

Such ingot moulds are located downstream of a tundish and upstream of a discharge roller conveyor.

Continuous casting ingot moulds contain a crystallizer, or downstream mould portion, of a pre-set section which upon start-up cooperates with a movable bottom, to which is fitted a pinetree-shaped element for attachment to the cast liquid metal.

This movable bottom is connected to a starter bar that cooperates with a discharge roller conveyor positioned downstream of the mould so as to draw the ingot being formed.

It is known that the ingots being formed and leaving the mould are additionally cooled by suitable cooling means that act directly on the ingot being formed.

The skin of the ingot at the outlet of the crystallizer may be thin, and therefore the ingot has to be suitably contained by the foot rolls and conveyed to the discharge roller conveyor.

These foot rolls form series of two, three, four or more succesive layers of assemblies of rolls cooperating together. Each assembly consists of idler rolls able to rotate about their respective supporting shafts.

These idler rolls are positioned in such a way as to come into contact with the whole perimeter of the ingot being formed so as to prevent non-homogeneous pressures.

The supporting shafts which bear the idler rolls are upheld by suitable uprights.

The state of the art generally employs two solutions:

bearings that bear the idler rolls, whereby the idler rolls rotate about their respective supporting shafts secured to the uprights;

bearings that bear the supporting shaft, whereby the idler rolls are integrally secured to their respective supporting shafts able to rotate in relation to the uprights.

The solution whereby the bearings bear the idler rolls is generally employed because it is safer and less expensive.

From a dynamic point of view the foot rolls are little stressed but are heavily stressed from a thermal point of view; for this reason the cooling means spray the ingot being formed with water under high pressure and at the same time also bathe and cool the idler rolls and the respective supporting shafts.

So as to reduce the thermal shock further, suitable inner conduits coaxial with the supporting shafts are included, and through these conduits a cooling liquid consisting of water is passed.

In the state of the art each supporting shaft includes at the ends of each inner conduit an inlet and an outlet, the conduits being connected in series with flexible tubes.

These flexible tubes are located in a zone in which a breakage of the skin of the ingot being formed brings the liquid metal into contact with the flexible tubes, thus causing wear of the tubes and impairing their functioning.

Moreover, the cooling systems for the foot rolls of the state of the art do not ensure efficient cooling of the idler rolls, which thus become worn excessively.

SUMMARY OF THE INVENTION

The present applicant has designed, tested and embodied this invention so as to obviate such shortcomings and achieve further advantages.

The purpose of this invention is to provide foot rolls which ensure efficient cooling of the idler rolls, supporting shafts and relative bearings;

This is achieved owing to a suitable system of inner conduits for the passage of a cooling liquid. These inner conduits are coaxial with the supporting shafts and cooperate with a cooling chamber within the relative idler roll. This cooling chamber cooperates directly with the sidewalls of the idler roll.

Thus an efficient cooling of the idler rolls and supporting shafts is achieved and the thermal shock which affects them is reduced.

Therefore the idler rolls according to the invention last longer and the downtimes due to their replacement are limited and output is increased.

Furthermore, the invention arranges to reduce to a minimum or, even better, to eliminate the flexible tubes so as to prevent problems of defective functioning when there are leakages of the liquid metal.

According to one embodiment the layers of assemblies of foot rolls according to the invention are connected together in series.

When the foot rolls according to the invention are connected together in series, the foot rolls comprise, at least for the two upper assemblies, only one outer tube for the entry of cooling liquid and one outer tube for the discharge of the same from the second assembly.

According to a preferred embodiment of the invention, whereby a plurality of assemblies of foot rolls are connected in series, the inlet conduit cooperates with the first upper assembly of foot rolls, while the discharge conduit cooperates with the lowest assembly of the foot rolls.

According to a variant the assemblies of foot rolls according to the invention are connected together in parallel. In this case the foot rolls include one outer tube for the entry of cooling liquid for each assembly and also include one single discharge conduit for all the assemblies.

According to a further variant which is suitable in the case of a great number of assemblies of foot rolls, the assemblies of foot rolls are connected in a combined manner, both in series and in parallel.

The foot rolls according to the invention provide the further advantage of eliminating the outer flexible connecting tubes, at least for the first two assemblies, so as to restrict the risks of damage of such outer flexible connecting tubes. According to the invention each assembly of foot rolls consists of idler rolls able to rotate about their respective supporting shafts and lying substantially on the same plane as each other and positioned in a coordinated sequence.

The end portions of two successive shafts are supported and positioned in uprights having a hollow section.

According to a variant these uprights having a hollow section act also as conduits for the cooling liquid. This solution enables an efficient cooling of the frame too upholding the idler rolls to be achieved.

Suitable connecting holes connect together the inner conduits in successive shafts.

According to a variant the shafts of all the idler rolls are standardized and the same as each other so as to reduce the spare parts.

According to another variant the shafts protrude at one of their ends from one of the two uprights with which they cooperate and are clamped and secured at that end.

According to another variant the supporting shafts have an eccentric seating so that the distance between the idler rolls can be adjusted.

BRIEF DESCRIPTION OF THE DRAWINGS

Let us now see a preferred embodiment of the invention with the help of the attached figures, which are given as a non-restrictive example and in which.

DETAILED DESCRIPTION OF THE PREFERRED EMBODIMENTS

In the figures the reference number 10 indicates generally the foot rolls according to the invention.

The foot rolls 10 according to the invention are located immediately downstream of an ingot mould of the state of the art, which is not shown here.

A discharge roller conveyor 11 to draw the ingot being formed cooperates downstream of the foot rolls 10.

In this case the discharge roller conveyor 11 is of a curved type but could be of any other type. Moreover, the example shown provides for an ingot of a substantially square section, but the ingot could have any other section.

Figure 1:
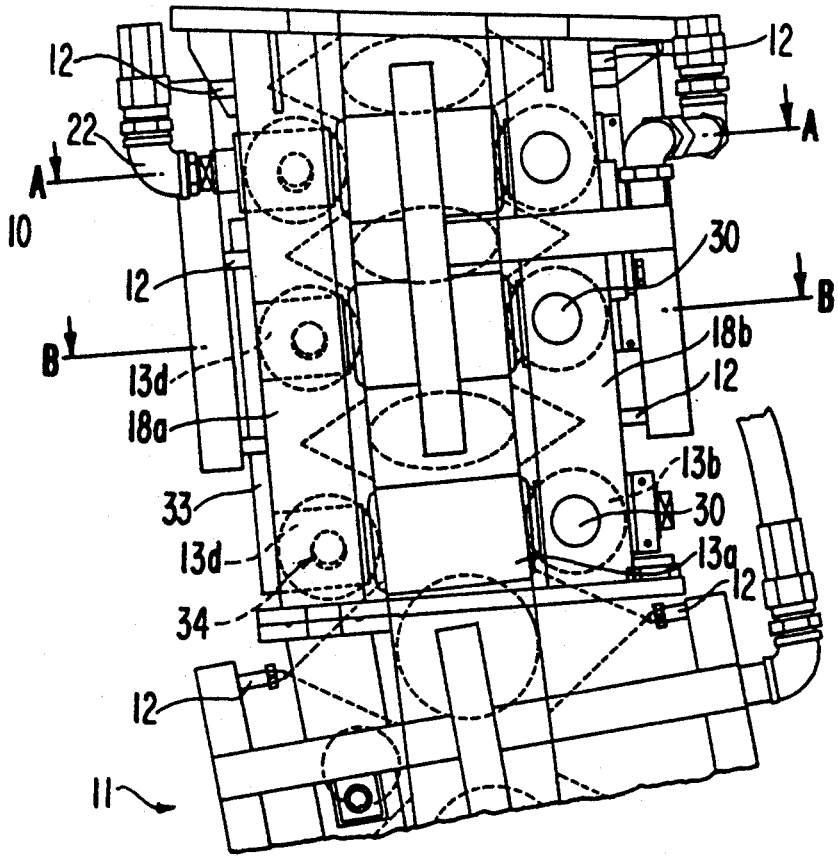
FIG. 1 is a side view of foot rolls according to the invention.
Figure 4:
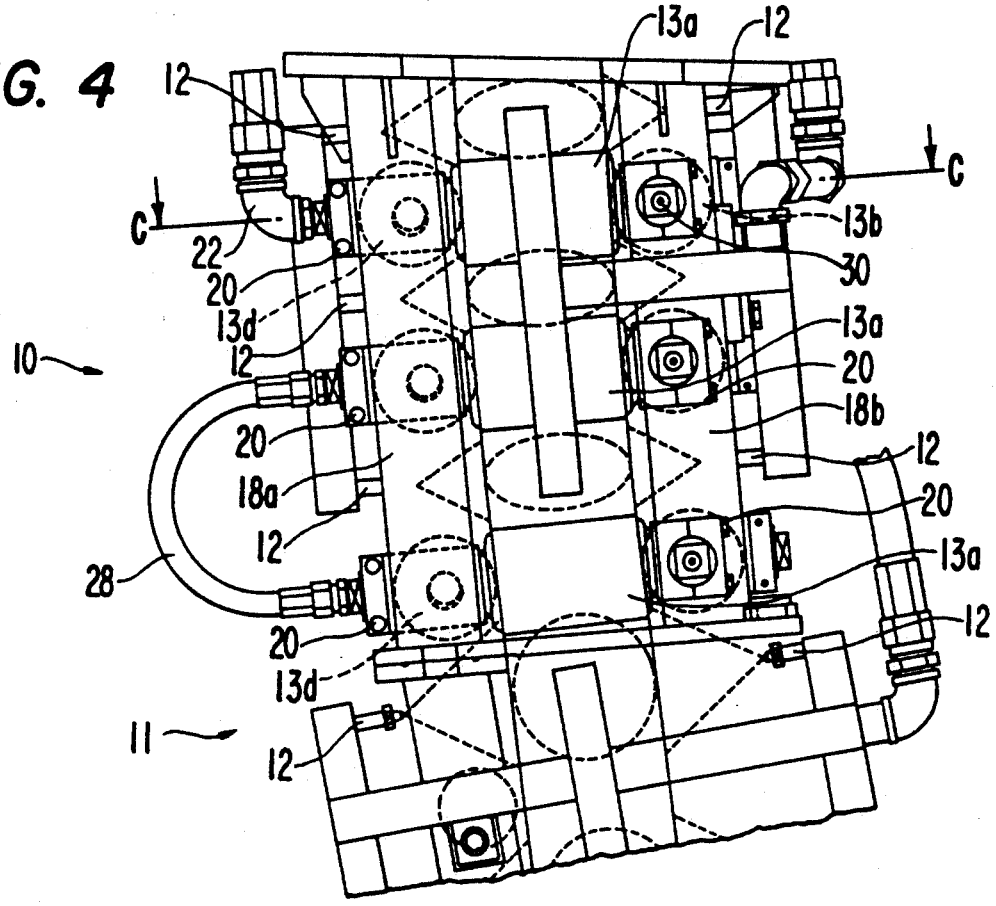
FIG. 4 shows a variant of FIG. 1.
Figure 2:
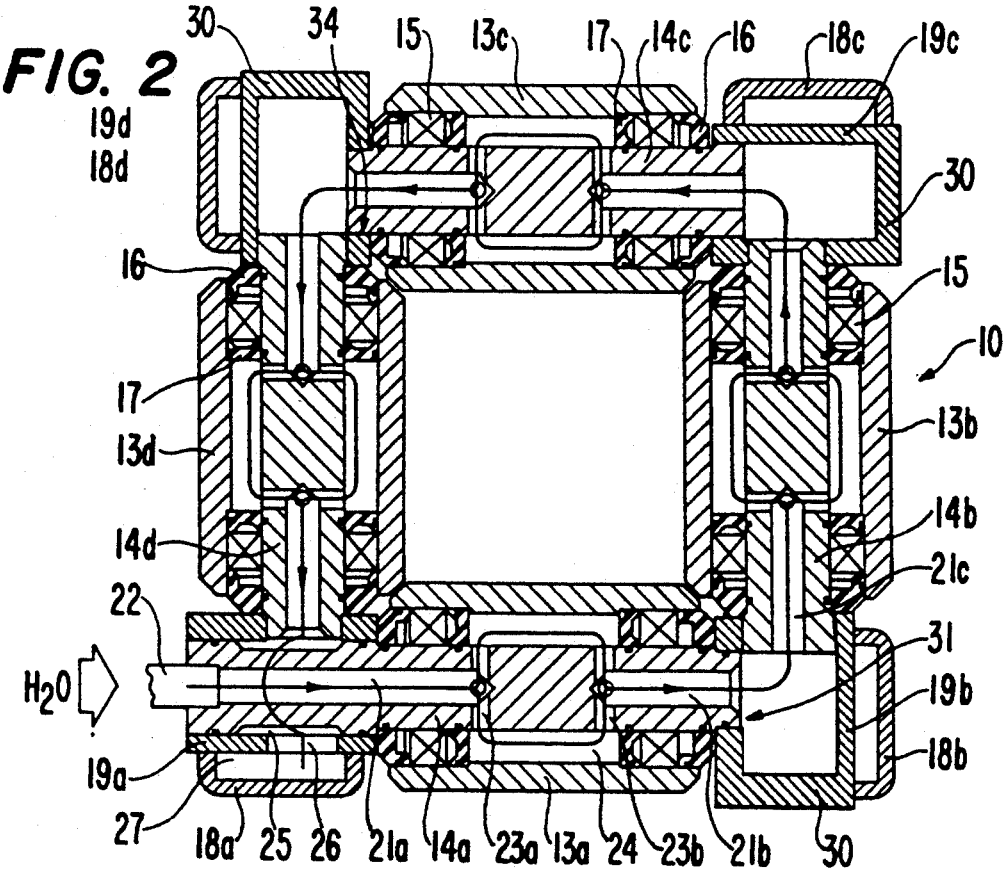
FIGS. 2 and 3 show the sections A—A and B—B respectively of FIG. 1.

FIGS. 1 and 4 show sprayers 12 of the state of the art, which spray the ingot being formed with cooling water.

In this case the foot rolls 10 consist of three layers of assemblies cooperating with each other. Each assembly comprises four idler rolls 13 supported on bearings 15 borne on respective supporting shafts 14, all of which lie on the same plane.

The four idler rolls 13 are arranged along the four sides of the ingot and are substantially in contact with the whole perimeter of the ingot being formed.

The bearings 15 are shielded against infiltrations of water or other substances by suitable outer 16 and inner 17 annular packings positioned between the supporting shaft 14 and the idler roll 13.

The end portions of the supporting shaft 14 cooperate with housings 19 integrally secured to four uprights 18 having a hollow section.

A first supporting shaft **14*a* has one end wholly inserted into and solidly secured to a first housing 19*a* included in a first upright 18*a*, whereas its other end is anchored in a hole 31 in a second housing 19*b* solidly fixed to a second upright 18*b***.

The second housing **19*b* bears one end portion of a second supporting shaft 14*b*, which has its other end portion secured in a third housing 19*c* solidly fixed to a third upright 18*c***.

The same situation applies to the other supporting shafts 14.

In this example the four uprights **18*a*-18*b*-18*c*-18*d* are located at the four corners of a square, while the four supporting shafts 14*a*-14*b*-14*c*-14*d*** form the sides of that square.

The first supporting shaft **14*a* contains a first inner coaxial conduit 21*a* fed by a flexible tube 22** that delivers water.

In correspondence with the first idler roll **13*a* there are included in the first inner conduit 21*a* first radial conduits 23*a* which cooperate with the frontal part of a cooling chamber 24 machined within the first idler roll 13*a*, so that the cooling liquid passing through comes into contact with the inside of the first idler roll 13*a*** and cools the same.

In correspondence with the rear part of the cooling chamber 24 the first supporting shaft **14*a* contains second radial conduits 23*b* cooperating with a second inner conduit 21*b*, which cooperates with the hole 31 contained in the second housing 19*b***.

The second idler roll **13*b* and the other idler rolls 13*c*–13*d* are conformed internally like the first idler roll 13*a***, so that the path of the cooling liquid is the same therein.

Second **19*b*, third 19*c* and fourth 19*d* housings comprise closure means 30** to prevent escape of the cooling liquid.

The first housing **19*a* in cooperation with a passage 25 provided between the inner wall of the first housing 19*a* and a narrowed portion of the first supporting shaft 14*a* includes a connecting hole 26, which connects the passage 25 to a vertical cavity 27 in the first upright 18*a***.

This vertical cavity 27 enables the cooling liquid to pass from the first assembly of foot rolls 10 according to the invention to the second assembly of the same 10.

Figure 3:
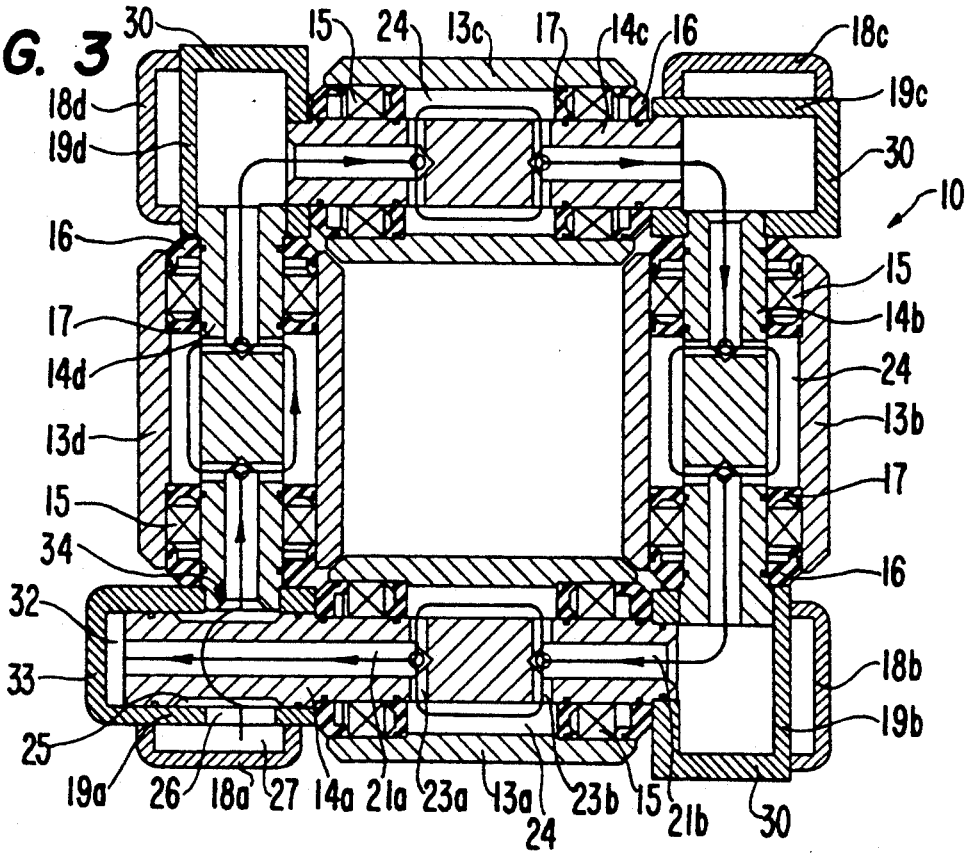
Figure 6:
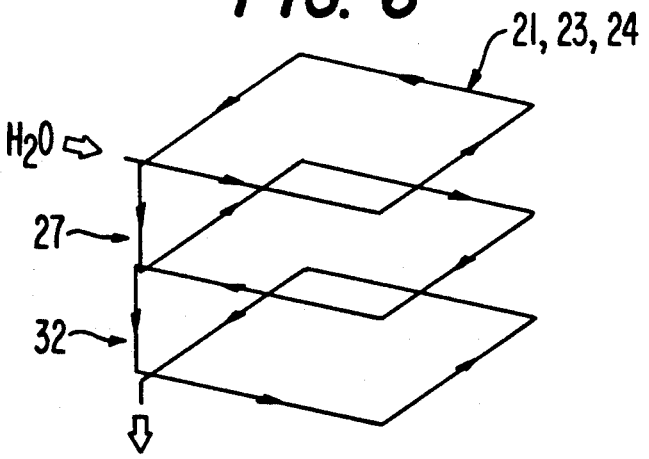
FIGS. 6–8 show possible paths of the cooling liquid according to the invention.

The second assembly is exactly the same as the first assembly, but the cooling liquid circulates in the opposite direction to the circulation in the first assembly (see FIGS. 3 and 6).

The movement of the cooling liquid from the second assembly to the third assembly is achieved owing to an auxiliary inner conduit 32, which is obtained by securing a suitable vertical connecting element 33 of the relative first housing **19*a* of the second assembly of foot rolls 10 to the relative corresponding first housing 19*a* of the third assembly of foot rolls 10**.

FIG. 6 shows the path followed by the cooling liquid in the above case of three assemblies of idler rolls 13 connected in series. The horizontal segments show the movement of the liquid through the inner conduits 21, radial conduits 23 and cooling chamber 24, while the vertical segments show the movement of the liquid through the vertical cavity 27 of the first upright **18*a* and through the auxiliary inner conduit 32**.

In this example only one outer tube for the entry of cooling liquid and one outer tube for the discharge of the liquid are comprised.

Figure 7:
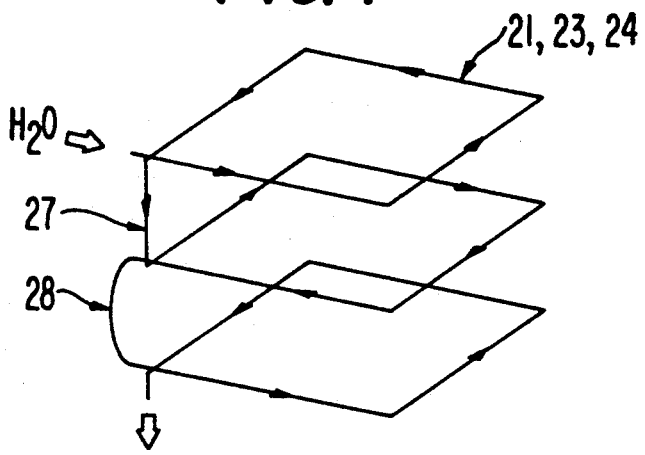

According to the variant shown in FIG. 7 the connection between the second and third assemblies of idler rolls 13 is provided by a connection consisting of an outer flexible tube 28.

In the event of foot rolls 10 forming four assemblies of idler rolls 13, the connection between the first three assemblies of idler rolls 13 remains the same as that described above (FIGS. 6 and 7), whereas the connection between the third and fourth assemblies of idler rolls 13 is exactly like that between the first and second assemblies of rolls 13.

Likewise, the concepts disclosed can be applied to a greater number of assemblies of rolls 13.

Figure 8:
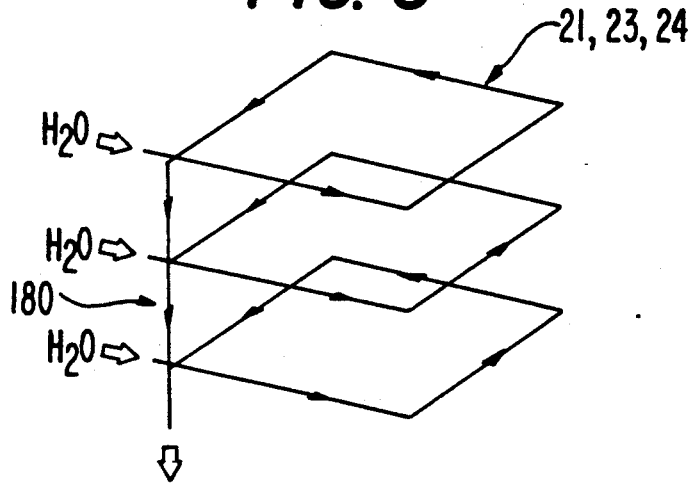

The variant shown in FIG. 8 represents the path followed by the cooling liquid when three assemblies of idler rolls 13 are connected in parallel. In this case the vertical segments show the movement of the liquid through the continuous inner cavity of the first upright 18*a*.

In this example an outer tube is provided for the entry of cooling liquid into each assembly of rolls 13, but only one discharge tube is provided for discharge from all the assemblies.

Figure 5:
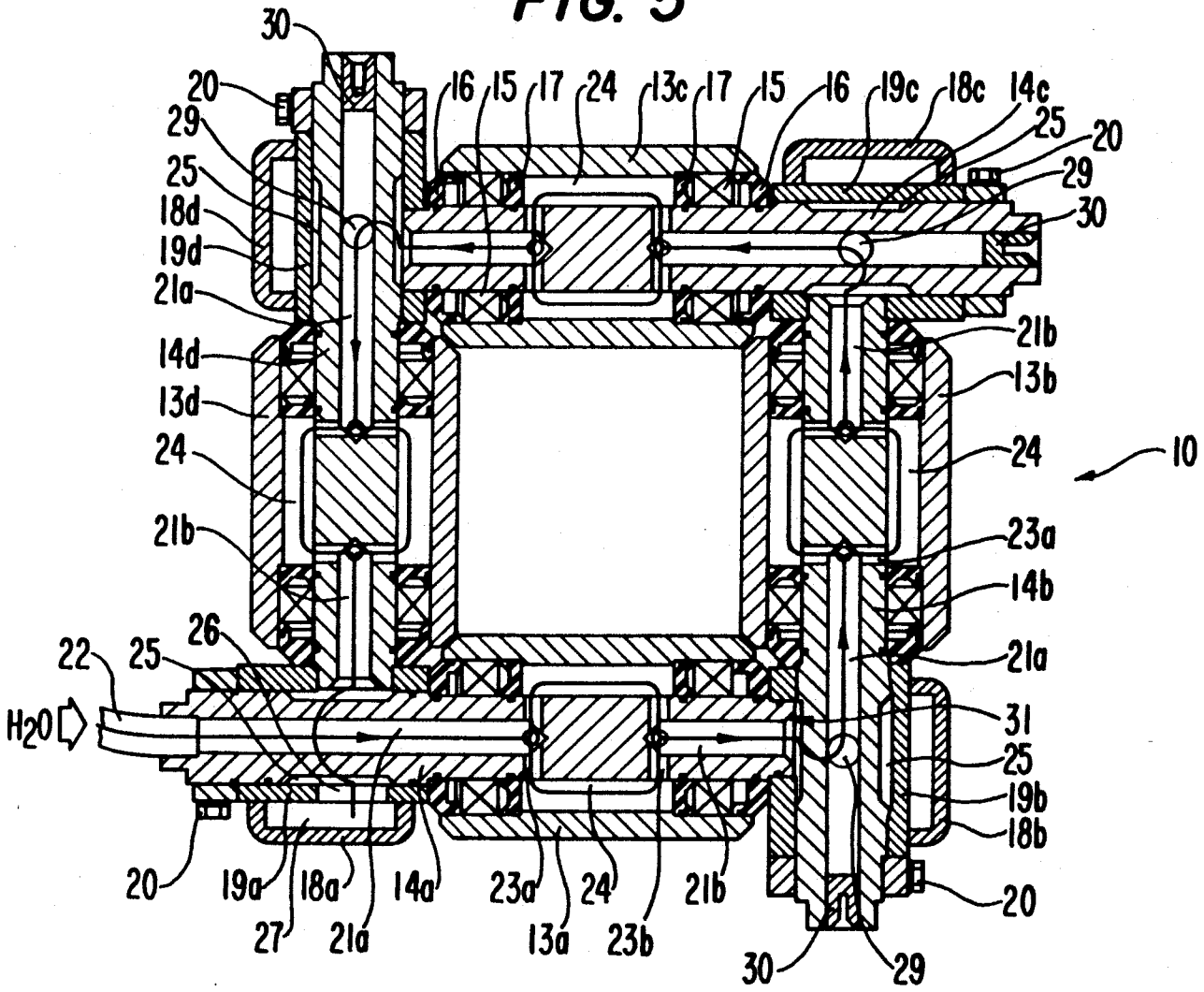
FIG. 5 shows the section C—C of FIG. 4.

According to a variant shown in FIG. 4 and 5 all the supporting shafts 14 are substantially the same as each other.

The first supporting shaft 14*a* has one end solidly fixed, owing to suitable fixture means 20, to the first housing 19*a* in the first upright 18*a*, whereas the other end of that shaft 14*a* is secured in the hole 31 contained in the second housing 19*b*.

As in the case described above, the first supporting shaft 14*a* contains a first inner conduit 21*a*, a cooling chamber 24 and a second inner conduit 21*b*.

The second inner conduit 21*b* cooperates with a second passage 25 machined between the inner wall of the second housing 19*b* and a corresponding narrowed portion of the second supporting shaft 14*b*.

In this example the second supporting shaft 14*b* in cooperation with the second passage 25 comprises at least one connecting conduit 29, which has a substantially radial axis and connects the second passage 25 to the first inner conduit 21*a*.

The successive rolls of one and the same assembly have a circulation of cooling liquid substantially the same as that of the first roll 13*a*.

In the example of FIG. 4 the second assembly of rolls 13 has the cooling liquid outlet corresponding with the first inner conduit 21*a*, which is connected by flexible tubes to the third assembly of rolls 13 (see the drawing of FIG. 7).

The third and possible fourth assemblies of rolls 13 work like the first and second assemblies.

According to a variant the supporting shafts 14 have an eccentric seating 34 (see the dotted lines within the roll 13*d* in FIGS. 1 and 4), so that the axes of rotation of the rolls 13 are eccentric in relation to the axes of the relative supporting shafts 14.

In this way, when the supporting shafts 14 rotate, the rolls 13 approach, or become distanced from, each other.

We claim:

1. Foot rolls for continuous casting which consist of at least two successive layers of assemblies of rolls, each assembly of rolls lying substantially on the said plane, the foot rolls being positioned immediately downstream of an ingot mould and immediately upstream of a discharge conveyor, each assembly of rolls defining a geometric figure conforming to the cross section of the ingot being formed, the rolls containing a stationary, cooled supporting shaft secured at its ends to vertical uprights, the rolls being supported on bearings keyed to their respective shafts, the shafts being supported and positioned on the uprights by housings connecting terminal portions of adjacent shafts, the foot rolls being characterized in that each shaft contains therewithin a first inner conduit connected to first radial conduits opening out at one end of a cooling chamber within the respective roll, the cooling chamber cooperating at its other end with second radial conduits connected to a second inner conduit contained within the respective shaft, the second inner conduit directly opening out in a passage machined in a respective housing that supports the terminal portions of two consecutive shafts.

2. Foot rolls as claimed in claim 1, whereby the shafts (14*a*) successive to the first shaft (14*a*) contain at least one connecting conduit in correspondence with the passage in the respective housing.

3. Foot rolls as claimed in claim 1 whereby at least one upright performs the task of a conduit that connects at least two assemblies of rolls.

4. Foot rolls as claimed in claim 1, whereby in correspondence with the passage the respective housing upstream of the first shaft (26) there is included a hole (26) which connects the passage (25) to a vertical cavity (27) contained in the first upright, this vertical cavity being connected to the underlying passage in the second assembly of rolls (26) by a connecting hole (26).

5. Foot rolls as claimed in claim 1, whereby the first inner conduit in the first shaft of the second assembly of rolls opens out into an auxiliary inner conduit that connects the second assembly of rolls to the third assembly of rolls.

6. Foot rolls as claimed in claim 1, whereby the first inner conduit in the first shaft of the second assembly of rolls opens out into a flexible tube which connects the first shaft of the third assembly of rolls.

7. Foot rolls as claimed in claim 1, whereby at least two assemblies of rolls are connected together in series through the first upright.

8. Foot rolls as claimed in claim 1, whereby at least two assemblies of rolls are connected in parallel through the first upright.

9. Foot rolls as claimed in claim 1, whereby the supporting shafts have an eccentric seating for their adjustment.

* * * * *